US005278130A

United States Patent [19]

Arita et al.

[11] Patent Number: 5,278,130

[45] Date of Patent: Jan. 11, 1994

[54] PRINTING SHEET FOR VIDEO IMAGES

[75] Inventors: Hitoshi Arita; Yoshio Fujiwara, both of Kanagawa, Japan

[73] Assignee: Sony Corporation, Tokyo, Japan

[21] Appl. No.: 857,649

[22] Filed: Mar. 26, 1992

[30] Foreign Application Priority Data

Mar. 26, 1991 [JP] Japan ..... 3-062013

[51] Int. Cl.[5] ..... B41M 5/035; B41M 5/38

[52] U.S. Cl. ..... 503/227; 428/195; 428/500; 428/522; 428/535; 428/913; 428/914

[58] Field of Search ..... 8/471; 428/195, 500, 428/535, 913, 914, 522; 503/227

[56] References Cited

U.S. PATENT DOCUMENTS 5,013,710 5/1991 Kanto et al. ..... 503/227

FOREIGN PATENT DOCUMENTS 0178332 4/1986 European Pat. Off. ..... 503/227

*Primary Examiner*—Bruce H. Hess

*Attorney, Agent, or Firm*—Hill, Steadman & Simpson

[57] ABSTRACT

A video image printing sheet which is used in combination with a dye transfer sheet having a dye layer or a dye-containing ink layer and which comprises an image-receiving layer capable receiving a pattern of a dye melted or sublimated by heating of the dye layer or the dye-containing layer is described. The image-receiving layer is made of a cellulose ester. Resins other than the cellulose ester may be contained in the image-receiving layer in amounts of not larger than 50 wt %. In addition, compounds capable of enhancing dyeability and miscible with the resins may be added. The image formed by the transfer of the dye has good light fastness and good weatherability.

7 Claims, 1 Drawing Sheet

PRINTING SHEET FOR VIDEO IMAGES

BACKGROUND OF THE INVENTION

1. Field of the Invention

This invention relates to the art of video images and more particularly, to a printing sheet for video images which has an image-receiving layer mainly composed of cellulose esters.

2. Description of the Prior Art

Attempts have been heretofore made on recording or printing of video images wherein an ink ribbon which has a sublimable disperse dye layer is heated by means of a thermal head in the form of dots according to image signals to transfer the sublimated dye onto a surface of a resin-coated sheet thereby forming an image on a printing sheet for the video images. As is particularly shown in FIG. 1, the video image printing sheet has a double-layer structure including an image-receiving layer 3 and a support sheet 2. The image-receiving layer 3 is able to receive image of a dye, such as a sublimable disperse dye, transferred from the ink ribbon to maintain the transferred image. Known materials for the image-receiving layer include polyesters, polycarbonates, vinyl chloride copolymers, and the like.

However, conventional video image printing sheets of the type wherein the receiving layer is made of the above-indicated resin are not satisfactory with respect to the light fastness and weatherability of the formed images, thus sometimes leading to a lowering in the brightness of the once formed images to bring about discoloration of the images. This is considered for the reason that the dye transferred by means of the thermal head is present in the vicinity of the surface of the image-receiving layer, so that the dye is liable to be adversely influenced by light, humidity and oxygen in air.

SUMMARY OF THE INVENTION

It is accordingly an object of the invention to provide a printing sheet for video images which ensures formation of images by transfer of a dye which have good light fastness and good weatherability.

It is another object of the invention to provide a video image printing sheet which has an image-receiving layer mainly composed of a cellulose ester whereby good light fastness and weatherability are attained.

The above objects can be achieved, according to the invention, by a video image printing sheet which is used in combination with a dye transfer sheet having a support and a dye layer or a dye-containing ink layer formed on the support so that the dye layer or the dye-containing ink layer is melted or sublimated in a pattern according to image signals to transfer the dye on an image-receiving layer of the printing sheet, the image-receiving layer comprising a cellulose ester resin.

BRIEF DESCRIPTION OF THE DRAWING

The sole FIGURE is a schematic sectional view of a video image printing sheet.

DETAILED DESCRIPTION OF THE INVENTION

Figure 1:
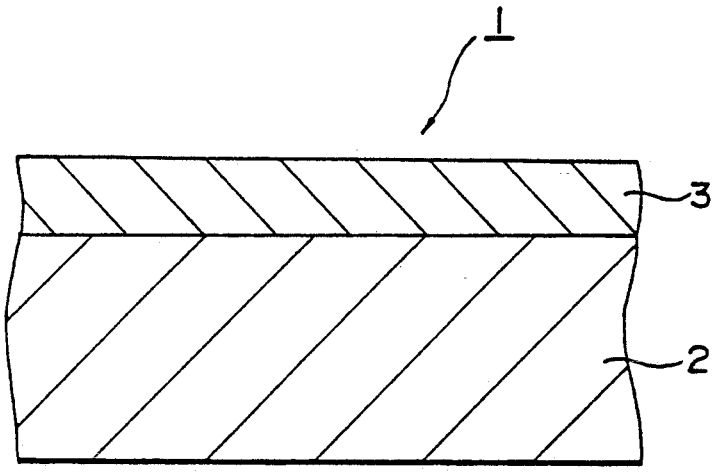

The video image printing sheet of the invention has such a structure as described hereinbefore with respect to the prior art sheet. More particularly, as shown in the sole FIGURE, a printing sheet 1 has a support sheet 2 and an image-receiving layer 3 formed on the sheet 2. The printing sheet 1 of the invention is particularly suitable for use in combination with a dye transfer sheet of the type wherein layer of a dye or a dye-containing ink supported on a substrate is heated in a pattern according to image signals to cause the dye to be melted or sublimated. The melted or sublimated dye is transferred on the image-receiving layer 3 made primarily of a resin. In the practice of the invention, it is essential that the resin of the layer 3 be made of a cellulose ester. Preferably, the resin should contain not larger than 50 wt % of a resin other than and miscible with the cellulose ester, based on the total resin composition. Moreover, it is also preferred that the image-receiving layer further comprises a compound which is miscible with the cellulose ester and can enhance dyeability.

The image-receiving layer of the printing sheet according to the invention is made of a cellulose ester resin and is significantly improved in light fastness over those which make use of polyester resins. The light fastness can be further improved when the layer is formulated with a defined amount of a compound capable of enhancing dyeability. A more improvement of the light fastness is possible when resins other than the cellulose ester resin are added to the layer.

The present invention is described in more detail.

The video image printing sheet of the invention is designed to use in combination with a dye transfer sheet or an ink ribbon which has a layer containing a dye capable of being transferred by melting or sublimation by application of heat thereto. The dye transferred from the ink ribbon is received on the dye-receiving layer formed on the support sheet. The cellulose ester resins used as the dye-receiving layer include, for example, cellulose acetate butyrate (CAB), cellulose acetate propionate (CAP), cellulose acetate (CA) and the like.

These cellulose esters are prepared by esterification between cellulose and organic acids. CAB, CAP, CA and the like are commercially available. Besides, there may be further used in the practice of the invention those esters of cellulose with aromatic acids such as benzoic acid, toluic acid and the like and also with fatty acids such as caproic acid, lauric acid and the like.

The molecular weight of the cellulose esters should preferably be in the range of from 10,000 to 70,000 for CAB, from 10,000 to 80,000 for CAP and from 30,000 to 60,000 for CA. The degree of the esterification should preferably be such that the esters are soluble in non-polar solvents such as benzene, toluene and the like. The degree of the esterification of the commercially available cellulose esters is, for example, a degree of acetylation of from 2 to 30% for CAB, from 0.5 to 3% for CAP and about 40% for CA. A degree of butylation is in the range of from 17 to 60% for CAB and a degree of propionylation is about 50% for CAP.

The commercially sold cellulose esters which are suitable for the practice of the invention include, for example, cellulose acetate butyrate products such as CAB551-a01, CAB551-0.1, CAB551-0.2, CAB531-1, CAB500-1, CAB500-5, CAB553-0.4, CAB381-0.1, CAB381-0.5, CAB381-0.5BP, CAB381-2, CAB381-2BP, CAB381-20, CAB381-20BP and CAB171-15S, cellulose acetate propionate products such as CAP482-0.5, CAP482-20 and CAP504-0.2, and cellulose acetate products such as CA-394-60S, CA-398-3, CA-398-6, CA-398-10 and CA-398-30, all of which are available from EASTMAN KODAK CO., LTD.

Additives which are miscible with the cellulose esters to increase dyeability of dyes and to improve light fastness and heat resistance include various types of esters, ethers and hydrocarbon compounds. These compounds are completely miscible with cellulose esters and are considered to form an amorphous mixture with the cellulose ester, so that diffusion of a dye is facilitated to cause the dye to be penetrated into the inside of the resultant image-receiving layer. All the ester, ether and hydrocarbon compounds which have a melting point of from −50° C. to approximately 150° C. and are liquid or solid in nature may be used in the practice of the invention. Specific examples of the esters include phthalic esters such as dimethyl phthalate, diethyl phthalate, dioctyl phthalate, dicyclohexyl phthalate, diphenyl phthalate and the like, aliphatic dibasic acid esters such as dioctyl adipate, dioctyl sebacate, dicyclohexyl azelate and the like, phosphoric acid esters such as triphenyl phosphate, tricyclohexyl phosphate, triethyl phosphate and the like, isophthalic esters such as diethyl isophthalate, dicyclohexyl isophthalate and the like, higher fatty acid esters such as butyl stearate, cyclohexyl laurate and the like, silicic acid esters such as tetraethyl silicate, tetraphenyl silicate and the like, and boric acid esters such as tributyl borate, triphenyl borate and the like.

Examples of the ethers include diphenyl ether, dicyclohexyl ether, p-ethoxybenzoic acid methyl ether and the like. Examples of the hydrocarbon compounds include camphor, low molecular weight polystyrene, phenols such as p-phenyl phenol, o-phenyl phenol and the like, and sulfonic acid amides such as N-ethyltoluenesulfonic acid amide and the like.

The image-receiving layer may be made of mixtures of the cellulose esters and other resins. The follow resins may be used singly or in combination, which are indicated only for illustration and should not be construed as limiting the resins thereto.

(a) Resins having ester bonds

Polyester resins, polyacrylate resins, polycarbonate resins, polyvinyl acetate resins, styrene-acrylate resins, vinyltoluene acrylate resins (b) Resins having urethane bonds Polyurethane resins (c) Resins having amido bonds Polyamide resins (d) Resins having urea bonds Urea resins (e) Others Polycaprolactone resins, polystyrene resins, polyvinyl chloride resins and vinyl chloride copolymers, polyacrylonitrile and acrylonitrile copolymers.

Useful saturated polyesters are, for example, Vylon 200, Vylon 290 and Vylon 600 commercially available from TOYOBO CO., LTD., VE3600, XA6098 and XA7026 commercially available from UNITIKA LTD., and TP220 and TP235 commercially available from NIPPON SYNTHETIC CO., LTD. The polyesters include those of aromatic disbasic acids and glycols, aliphatic dibasic acids and glycols, and mixed esters of aromatic dibasic acids and aliphatic dibasic acids with glycols. Urethane resins include ether-type polyurethanes and ester-type polyurethanes which are, respectively, obtained from polyethers and polyesters having hydroxyl groups at ends thereof and isocyanates. The resins having amido bonds include not only nylons, but also polyamides derived from diamines having branched groups and dimer acids. The compounds or resins having urea bonds are, aside from those obtained by reaction between diamine acids and diisocyanates, reaction products between urea and aldehydes. In addition, polycaprolactones having ester bonds, polystyrene, vinyl chloride homopolymer and copolymers, acrylonitrile copolymers and the like are usable in the present invention.

Preferable vinyl chloride copolymers include vinyl chloride/vinyl acetate copolymers which has a vinyl chloride content of from 85 to 97 wt % and a degree of polymerization of from 200 to 800. Besides, those vinyl chloride copolymers containing a vinyl alcohol ingredient and a maleic acid ingredient are favorably used.

When cellulose ester resins are used in combination with other resins, other resins are preferably used in an amount of from 1 to 100 parts by weight per 100 parts by weight of the cellulose ester although depending on the type of cellulose ester.

In order to increase the definition of a transferred image by improvement of the brightness of the image-receiving layer, to impart the sheet surface with writeability and to prevent re-transfer of the once transferred image, there may be added fluorescent brighteners and white pigments.

Examples of the fluorescent brighteners include a variety of commercially available fluorescent brighteners such as Ubitex OB of Chiba Geigy Co., Ltd. Examples of the white pigments include titanium oxide, zinc oxide, kaolin, clay, calcium carbonate, finely divided silica and the like. These may be used singly or in combination.

To improve the light fastness of the transferred image, one or more additives such as UV absorbers, light stabilizers and antioxidants may be added to the image-receiving layer. When used, these fluorescent brighteners, white pigments, UV absorbers, light stabilizers and the like are, respectively, added in amounts of from 0.05 to 10 parts by weight per 100 parts by weight of the cellulose ester resin. Depending on the purpose, these additives may be added in amounts outside the above ranges and the above-indicated ranges are only for illustration. The invention is not limited to those ranges of the additives indicated above.

The video image printing sheet of the invention may contain a release agent on or in the image-receiving layer in order to improve the releasability from the ink ribbon sheet. Examples of the release agent include solid waxes such as polyethylene waxes, amide waxes, fluorine-containing resin powers such as teflon powders and the like, fluorine-containing and phosphoric acid ester surface active agents, silicone oils, high melting silicone waxes and the like. Of these, silicone oils are preferred.

The silicone oils may be oily or of the reactive or curing type which depends on the purpose. The reactive or curing-type silicones include combinations of alcohol-modified silicone oils and isocyanates. In addition, those silicone oils which are obtained by curing epoxy-modified silicone oils (epoxy/polyether-modified silicone oils) and carboxy-modified silicone oils, and amino-modified silicone oils (amino/polyether-modified silicone oils) and carboxy-modified silicone oils (carboxy/polyether-modified silicone oils) are preferably used. With the curing type silicone oils, the cured product is formed on the image-receiving layer. The thickness of the release layer should preferably in the range of from 0.01 to 5 μm although not limitative.

In order to suppress generation of static electricity during the course of fabrication of the video image printing sheet or during travel of the sheet in a printer, an antistatic agent may be contained in the image-receiving layer or may be formed as a layer on the layer surface.

Examples of the antistatic agent include surface active agents such as cationic surface active agents such as quaternary ammonium salts, polyamine derivatives and the like, anionic surface active agents such as alkylbenzenesulfonates, sodium alkylsulfate and the like, and amphoteric surface active agents, and nonionic surface active agents.

These antistatic agents may be formed on the surface of the image-receiving layer such as by coating or may be added to the cellulose ester resin.

The support of the sheet may be paper sheets including synthetic paper, or plastic sheets.

The present invention is more particularly described by way of examples.

In examples and comparative examples, dyes used to form ink layers are as follows.

(1) Methine dyes (A): Macrolex Yellow 6G of BAYER A. G.

(2) Methine dye (B): Foron Brilliant Blue of SR-PI SANDOZ CO., LTD.

(3) Anthraquinone dye (C): Sumikaron Red Violet R of Bayer A. G.

(4) Azo dye (D): Sumikaron Red S-BDF of SUMITOMO CHEM. CO., LTD.

(5) Indoaniline dye (E):

(6) Yellow (Ribbon VPM-30ST for printing material of SONY CO., LTD.)

Magenta (Ribbon VPM-30ST for printing material of SONY CO., LTD.)

Cyan (Ribbon VPM-30ST for printing material of SONY CO., LTD.)

(7) Yellow Ribbon UPC-3010 for printing material of SONY CO., LTD.)

Magenta (Ribbon IPC-3010 for printing material of SONY CO., LTD.)

Cyan (Ribbon UPC-3010 for printing material of SONY CO., LTD.)

The structural formula of Indoaniline dye (E) in (5) is shown below.

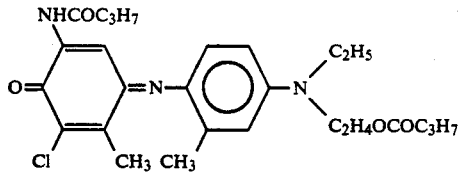

This dye is prepared by the following procedure.

For the preparation of an indoaniline derivative, 3 g of 2-(n-butyroylamino)-4,6-dichloro-5-methylphenol is dissolved in 200 g of ethanol, followed by addition of a solution of 8 g of sodium carbonate in 100 g of water and sufficient agitation. Thereafter, a solution of 5 g of 4-amino-N-(β-hydroxyethyl)-N-ethyl-m-toluidine sulfate in 100 g of water is further added to the mixture and agitated for 30 minutes, to which 15 g of a sodium hypochlorite solution is added portion by portion. After completion of the addition, the mixture is agitated for 10 minutes, followed by addition of 300 g of water and filtration to obtain crystals of the dye. The reaction sequence is shown below.

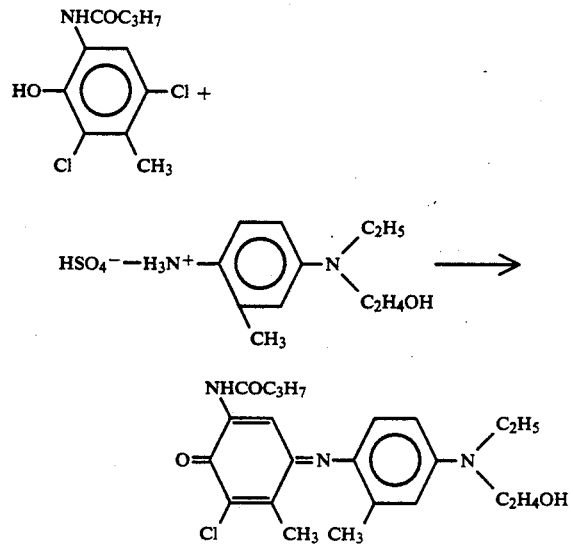

Next, 2 g of the dye crystals is dissolved in 50 g of pyridine, to which 0.6 g of butyryl chloride is added portion by portion, followed by refluxing for 1 hour for esterification. The reaction formula is shown below.

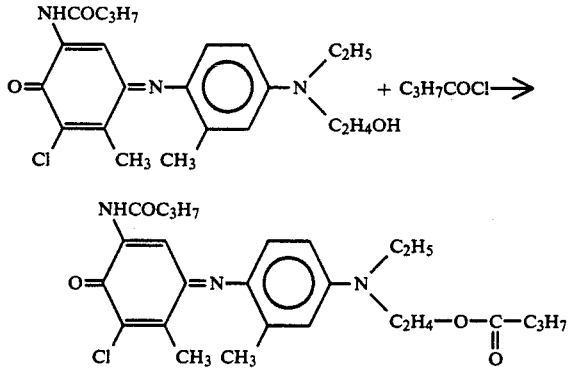

The resultant compound is subjected to column chromatography using chloroform as a developing solvent (filler: Wako Gel C-200 available from WAKO PURE CHEMICAL INDUSTRIES Ltd.) and purified to obtain dye 5.

(1) Fabrication of Ink Sheet

Ink layer compositions containing dyes of (1) to (5) were prepared as having the following formulation.

| Ink layer composition: | |
|---|---|
| Dye (one of the dyes of (1) to (5)) | 3.70 parts by weight |
| Eethylhydroxyethyl cellulose (EHEC-LOW of Hercules) | 7.42 parts by weight |
| Toluene | 44.44 parts by weight |
| Methyl ethyl ketone | 44.44 parts by weight |

Each mixture with the above formulation was agitated to obtain an ink layer composition. This ink layer composition was applied, by means of a coiled bar, onto a 6 μm thick, back-treated polyethylene terephthalate (PET) film in a dry thickness of about 1 μm to obtain a sublimation-type transfer sheet as an ink sheet.

The respective ink sheets thus obtained were used to thermal transfer printing on an image-receiving layer sheet on which an image was to be transferred.

(2) Fabrication of image-receiving layer sheets

Each sheet was fabricated by applying, onto a 150 μm thick synthetic paper (FPG-150 of OJI-YUKA SYNTHETIC PAPER CO., LTD.), an image-receiving layer composition in a dry thickness of 10 μm and curing at 50° C. for 48 hours. The image-receiving layer compositions have the following formulations.

| | |
|---|---|
| Resin (see Table 1) | 20.0 parts by weight |
| Compound used to enhance dyeability (see Table 1) | 0 to 4 parts by weight |
| Isocyanate (Takenate D-110N of Takeda Pharm. Co., Ltd.) | 1.0 parts by weight |
| Modified silicone oil (SF847 of DOW CORNING TORAY SILICONE CO., LTD.) | 0.6 parts by weight |
| Fluoescent brightener (Ubitex OB of CHIBA-GEIGY CO., LTD.) | 0.04 parts by weight |
| Methyl ethyl ketone | 40.0 parts by weight |

TABLE 1

Ingredients of Image-receiving Layer (parts by weight)

| | Example | | | | | | | | | | | | Comp. Ex. | |
|---|---|---|---|---|---|---|---|---|---|---|---|---|---|---|
| | 1 | 2 | 3 | 4 | 5 | 6 | 7 | 8 | 9 | 10 | 11 | 12 | 1 | 2 |
| Resins: | | | | | | | | | | | | | | |
| Cellulose Ester Resins: | 20 | 20 | | 10 | 10 | 10 | 10 | 10 | 10 | 10 | 10 | 10 | | |
| CAB resin 500-5 of E. Kodak | | | | | | | | | | | | | | |
| CAB resin 551-0.01 of E. Kodak | | | | 10 | 10 | 10 | 10 | 10 | | | | | | |
| CAP resin 48-0.5 of E. Kodak | | | 20 | | | | | | | | | | | |
| Other Resins: | | | | | | | | | | | | | | |
| Vinyl Acetate Resin Corbonyl C-5 of Sekisui Chem. Co., Ltd. | | | | | | | | | | 10 | 10 | | | |
| Polyester resin Vylon 200 of Toyobo Co., Ltd. | | | | | | | | | | | | | 20 | 20 |
| Vinyl Chloride-vinyl acetate copolymer, VMCH of Union Carbide Co., Ltd. | | | | | | | | | | | | 10 | | |
| Compounds for enhancing dyeability: | | | | | | | | | | | | | | |
| dicyclohexyl phthalate of Osaka Oranic Chem. Co., Ltd. | | 4 | 4 | 4 | | | 2 | 4 | 4 | | 4 | | | 4 |
| diphenyl phthalate of Tokyo Chem. Co., Ltd. | | | | | 4 | | | | | | | | | |
| dioctyl phthalate of Daihachi Chem. Co., Ltd. | | | | | | 4 | | | | | | | | |
| triphenyl phthalate of Daihachi Chem. Co., Ltd. | | | | | | | 4 | | | | | | | |

(3) Thermal Transfer Printing

The thermal transfer printing was effected by means of a color video printer (CVP-G500 of Sony Co., Ltd.) wherein twelve-graded step-up printing was made using the ink sheets and the image-receiving sheets.

(4) Light fastness test

The individual printed image-receiving layer sheets were irradiated with a Xenon arc fade meter (made by Suga Testing Machine Co., Ltd.) at 60,000 KJ/m$^2$ to measure a variation of the density. The variation of the density at approximately 1.0 was measured by means of the Macbeth densitometer (TR-924), thereby indicating a residual rate of a dye.

Residual rate of dye (%)=(density after irradiation with Xenon arc)/(density prior to irradiation with Xenon arc) ×100.

The results of the light fastness test are shown in Table 2 below.

TABLE 2

Results of The Light Fastness Test (residual rate %)

| Ink Sheet Image-Receiving Sheet | A | B | C | D | E | [1]VPM-30ST Yellow | [1]VPM-30ST Magenta | [1]VPM-30ST *Cyan | UPC-3010 Yellow | UPC-3010 Magenta | UPC-3010 Cyan |
|---|---|---|---|---|---|---|---|---|---|---|---|
| Ex. 1 | 80.2 | 47.6 | 67.8 | 59.2 | 72.3 | 78.3 | 65.3 | 52.4 | 68.5 | 62.3 | 64.8 |
| Ex. 2 | 92.6 | 76.3 | 89.5 | 85.5 | 82.7 | 93.0 | 91.3 | 80.4 | 100 | 91.7 | 80.0 |
| Ex. 3 | 86.3 | 57.7 | 89.8 | 81.6 | 83.2 | 85.1 | 80.5 | 56.1 | 93.2 | 91.2 | 72.3 |

TABLE 2-continued

| Ink Sheet Image-Receiving Sheet | Results of The Light Fastness Test (residual rate %) | | | | | | | | | | |
|---|---|---|---|---|---|---|---|---|---|---|---|
| | | | | | | [1]VPM-30ST | | | UPC-3010 | | |
| | A | B | C | D | E | Yellow | Magenta | *Cyan | Yellow | Magenta | Cyan |
| Ex. 4 | 93.0 | 78.3 | 90.1 | 85.6 | 82.5 | 94.3 | 91.2 | 80.5 | 100 | 91.5 | 79.2 |
| Ex. 5 | 91.3 | 76.5 | 89.8 | 85.2 | 83.0 | 93.2 | 90.5 | 79.5 | 100 | 90.5 | 79.5 |
| Ex. 6 | 89.3 | 64.5 | 89.8 | 80.3 | 80.5 | 88.7 | 85.3 | 61.7 | 92.5 | 89.1 | 76.3 |
| Ex. 7 | 91.1 | 78.3 | 89.2 | 86.2 | 82.0 | 92.5 | 91.3 | 79.8 | 98.5 | 90.3 | 79.6 |
| Ex. 8 | 87.6 | 54.6 | 85.3 | 84.3 | 75.7 | 71.3 | 73.9 | 54.8 | 70.6 | 76.2 | 72.5 |
| Ex. 9 | 89.4 | 73.8 | 89.1 | 85.1 | 82.3 | 92.6 | 90.3 | 79.2 | 86.8 | 89.3 | 78.3 |
| Ex. 10 | 93.8 | 63.2 | 88.7 | 86.7 | 88.5 | 93.2 | 89.3 | 63.5 | 94.5 | 88.7 | 86.2 |
| Ex. 11 | 86.5 | 60.4 | 89.2 | 86.5 | 87.6 | 87.2 | 89.2 | 64.3 | 95.6 | 89.4 | 85.3 |
| Ex. 12 | 84.5 | 73.3 | 84.5 | 83.2 | 38.2 | 84.0 | 84.5 | 75.2 | 82.6 | 81.3 | 30.6 |
| Comp. Ex. 1 | 36.5 | bleached | 52.8 | 47.8 | 65.3 | 39.2 | 50.4 | bleached | 35.1 | 48.2 | 49.3 |
| Comp. Ex. 2 | 48.5 | bleached | 60.3 | 58.1 | 67.8 | 45.8 | 59.3 | 38.1 | 42.5 | 59.1 | 53.3 |

*The printing was effected while preventing melt-fusion.
[1, 2]Printed with use of the commercially available printing ribbons.

As will be apparent from the test results of Table 2, the use of the cellulose ester resins results in greater values of the dye residual rate than those of Comparative Examples 1 and 2. It will be found that the addition of the compounds capable of enhancing the dyeability to the cellulose ester resins is substantially effective in improving the light fastness although not always significantly effective. On the other hand, when the vinyl acetate resin or polyester resin is added to the cellulose ester resins, the light fastness may be more improved.

What is claimed is:

1. A printing sheet for video images comprising:

a support and a dye-receiving layer formed on the support and is used in combination with a dye transfer sheet having a support and a dye layer or a dye-containing ink layer formed on the support, so that the dye layer or the dye-containing ink layer is melted or sublimated in a pattern according to image signals to transfer the dye on said image-receiving layer of the printing sheet, said image-receiving layer comprises a mixture of a cellulose ester resin and a resin other than the cellulose ester resin in an amount of from 0 to 50 wt % of the total resin and a compound which is miscible with the cellulose ester resin, which is a member selected from the group consisting of esters, ethers and hydrocarbon compounds, and which has a melting point of from −50° C. to approximately 150° C.

2. The printing sheet according to claim 1, wherein said cellulose ester resin is a member selected from the group consisting of cellulose acetate butyrate, cellulose acetate propionate and cellulose acetate.

3. The printing sheet according to claim 1, wherein the resin other than the cellulose ester resin is a vinyl chloride/vinyl acetate copolymer having a vinyl chloride content of from 85 to 97 wt % and a degree of polymerization of from 200 to 800.

4. The printing sheet according to claim 1, wherein said image-receiving layer further comprises a release agent.

5. The printing sheet according to claim 1, further comprising a layer of a release agent formed on the image-receiving layer.

6. The printing sheet according to claim 5, wherein said layer of the release agent is formed curing a modified silicone oil.

7. The printing sheet according to claim 1, wherein said compound is a member selected from the group consisting of phthalic esters, aliphatic dibasic acid esters, phosphoric acid esters, isophthalic esters, higher fatty acid esters, silicic acid esters, boric acid esters, diphenyl ether, dicyclohexyl ether, p-ethoxybenzoic acid methyl ether, camphor, low molecular weight polystyrene, phenols and sulufonic acid amides.

* * * * *